United States Patent [19]

Manetti

[11] 4,075,956

[45] Feb. 28, 1978

[54] AUTOMATIC APPARATUS FOR OBTAINING RING-SHAPED ARTICLES FROM AN ELONGATED PLAIT OR STRIP OF TEXTILE MATERIAL

[75] Inventor: Orlando Manetti, Valdobbiadene, Italy

[73] Assignee: Sigismondo Piva S.p.A., Milan, Italy

[21] Appl. No.: 705,118

[22] Filed: Jul. 14, 1976

[30] Foreign Application Priority Data

Jul. 18, 1975 Italy ..... 25539/75

[51] Int. Cl.[2] ..... D05B 33/02

[52] U.S. Cl. ..... 112/121.27; 270/83

[58] Field of Search ..... 112/121.27, 121.11, 112/121.15, 121.29, 147; 270/83

[56] References Cited

U.S. PATENT DOCUMENTS

| | | | |
|---|---|---|---|
| 2,874,659 | 2/1959 | Kehrer | 112/121.29 X |
| 3,402,926 | 9/1968 | Boodson | 270/83 |
| 3,610,186 | 10/1971 | Murdter | 112/121.29 |
| 3,780,679 | 12/1973 | Hanes, Jr. et al | 112/121.27 |
| 3,789,781 | 2/1974 | Carson et al. | 112/121.29 |

*Primary Examiner*—Werner H. Schroeder
*Assistant Examiner*—Peter Nerbun
*Attorney, Agent, or Firm*—Remy J. VanOphem

[57] ABSTRACT

An automatic apparatus for forming ring-shaped articles from an elongated plait or strip of textile material comprises roll means for continuously feeding the material to a cutting means, such as a shear, and to a folding means. The latter, adapted to fold a cut section of textile material in two portions of the same length comprises a blade reciprocating through an aperture in a vertical column in which the material slides. A plurality of box-shaped elements carry the folded sections to a sewing machine, where ring-shaped elements are formed by sewing together the ends of such sections. A discharging device comprises a movable arm oscillating between a first position wherein its free end is at the same level of the box elements and a second position wherein it has caught a ring-shaped article upon an upward rotation. The free end of the movable arm is bent in a direction opposite to the movement of the box elements.

8 Claims, 7 Drawing Figures

AUTOMATIC APPARATUS FOR OBTAINING RING-SHAPED ARTICLES FROM AN ELONGATED PLAIT OR STRIP OF TEXTILE MATERIAL

BACKGROUND OF THE INVENTION

This invention relates to an automatic apparatus for obtaining ring-shaped articles from an elongated plait or strip of textile material.

More in particular the present invention relates to an apparatus which provides for obtaining in a completely automatic way ring-shaped articles of a somewhat elastic material, having their most important application generally in the field of clothing and especially corsetry and underclothes, stockings and waist-stockings, swimsuits, etc.

At present, the manufacture of such rings of textile material is essentially carried out manually, since an operator must be continuously in attendance at the equipment which is used in the various steps. These comprise, as it is known, cutting the strip into sections of prefixed length, folding the sections in two halves and inserting the two ends to be sewed of said folded sections into a usual sewing-machine of the type with cutting means, from which the finished ring-shaped articles are then removed and forwarded to a discharging device. Except for the sewing operation performed in the sewing and cutting machine, all the other operations are carried out by hand, whereby a ring-shaped article of textile material is obtained after some time, which results in a high cost of each finished article. The number of the products is therefore greatly reduced and a possible increase in the number of articles manufactured depends heavily of the employed operator, and even by increasing the number of operators the problem may not be solved.

SUMMARY OF THE INVENTION

It is an object of the present invention, to provide an automatic apparatus for obtaining ring-shaped articles from an elongated plait or strip of textile material, which overcomes the above mentioned drawbacks as all the cited operations are effected by the apparatus itself without intervention of the operator, who is entrusted only with functions relating to checking the correct operation of the apparatus. Due to its complete automatism, a single operator can check more than one apparatus, thus rendering cheaper the cost of the products, which is another object of the present invention.

A further object is to provide such apparatus for obtaining finished articles being uniform and of constant quality, whereas the quality of the articles made at present varies with the employed operator.

According to the invention the automatic apparatus for obtaining ring-shaped articles from a plait or strip of textile material comprises: a continuously feeding station for the plait or strip, a cutting station for cutting the plait or strip into sections of prefixed length, the folding station for folding the sections from the cutting station, a transport station for carrying the folded sections to a sewing station wherein the ring-shaped articles are formed, a discharging device for receiving and discharging the finished ring-shaped articles from the transportation station.

BRIEF DESCRIPTION OF THE DRAWINGS

The features of the apparatus of the present invention will be better explained by the following detailed description of an embodiment given by way of example with reference to the annexed drawings, wherein.

DETAILED DESCRIPTION OF THE PREFERRED EMBODIMENT

Figure 1:
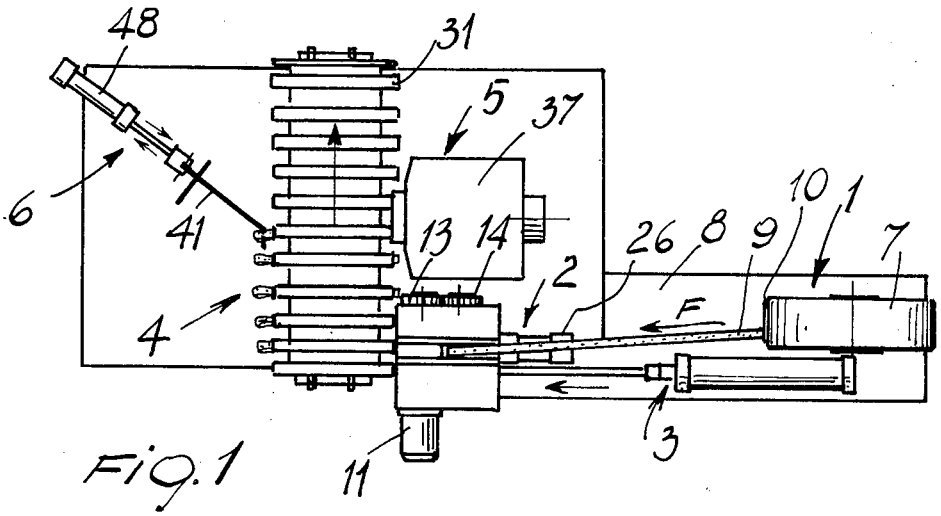
FIG. 1 is a diagrammatic plan view showing the overall apparatus.

With reference to FIG. 1, the automatic apparatus to form ring-shaped articles from a plait or strip of a textile material comprises a feed station 1 for continuously feeding a strip, a cutting station 2 to have sections of prefixed length, a station 3 for folding such sections, a transport station 4 for carrying the folded sections to a sewing station 5 and a receiving device 6 for subsequently discharging the finished ring-shaped articles into a receiving container.

With particular reference to FIGS. 1 to 3*a* the continuously strip feeding station comprises a cylindrical housing body 7 fixed to a resting plane 8 and having rotatably mounted therein a roll for feeding a strip 9. The housing body 7 can be opened at one of its bases for allowing an empty feeding roll to be replaced and it is provided with an aperture 10 through which the strip 9 is moved outwards along the direction of arrow F shown in FIG. 1. Any known means may be provided for supporting the roll for feeding strip 9 within the housing body 7; for example the roll may be provided with a shaft having the same length as the width of the housing body 7, whereby its ends can rest in suitable seats formed in the bases of the housing body 7. The feeding station 1 also comprises a driving motor 11 for drawing the strip 9, with a shaft 12 having integral thereto a driving gear 13 meshing with a driven gear 14 integral to a shaft 15 rotatable with respect to a frame 16 to which also the motor 11 is fixed. Within frame 16, there are fixedly mounted on the shafts 12 and 15 the rollers 17 and 18 between which the strip 9 is inserted and driven forward along the direction of arrow F by their rotation.

Rollers 17 and 18 are made of a proper material, such as rubber, so that they give the necessary friction to allow a constant feeding of the strip 9, having a horizontal portion 20 with C-shaped cross-section and a vertical portion 21 with a longitudinal groove 22. The end of groove 22 is placed above the point of contact between the rollers 17, 18 and the strip 9. A second horizontal portion 23 of the guide member is fixed to a bracket 24 mounted in turn to the frame 16.

Figure 2:
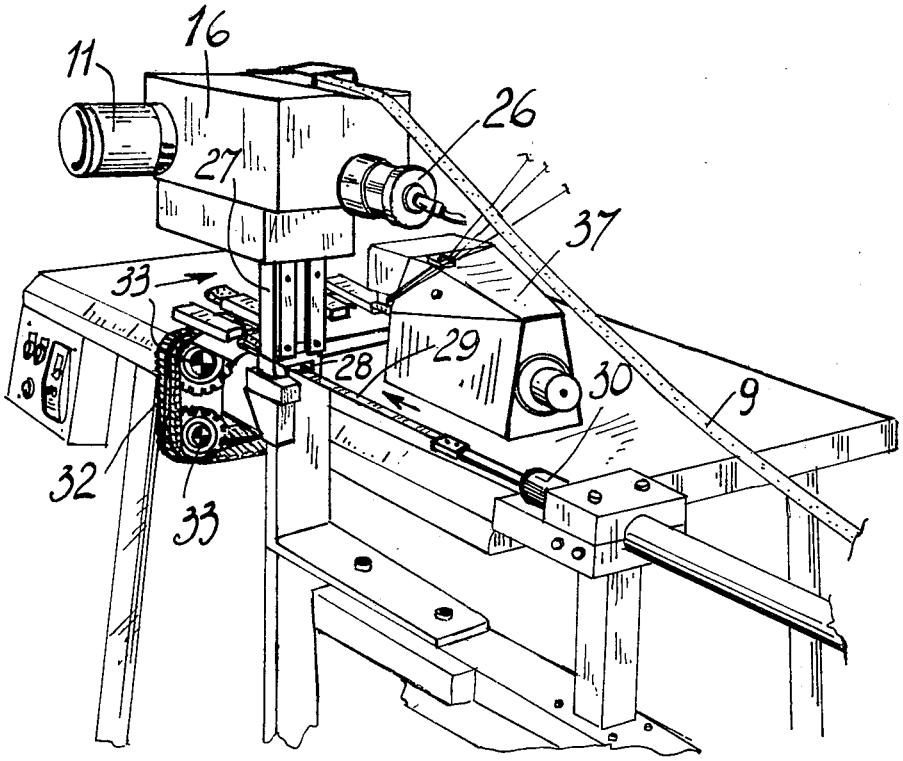
FIG. 2 is a perspective view also showing the overall apparatus.
Figure 3A:
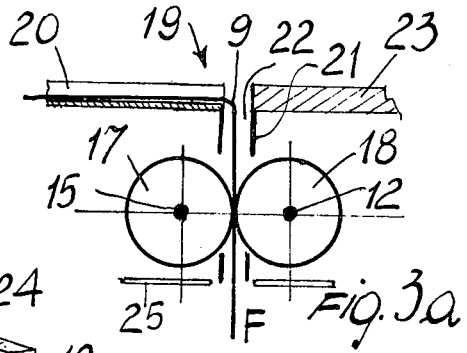
FIGS. 3 and 3*a* are side views showing in detail a portion of the continuously feeding station for feeding a plait or strip.
Figure 3:
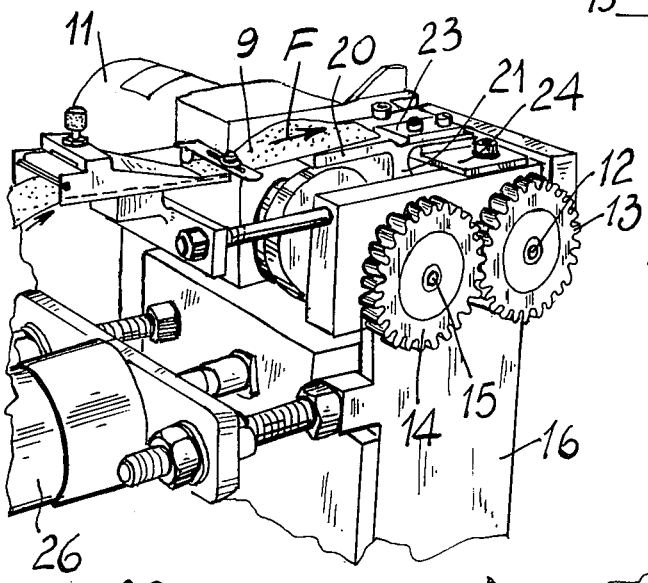

With particular reference to FIGS. 1, 2 and 3*a*, the cutting station for cutting strip 9 into sections of prefixed length comprises a shear 25 operated by a pneumatic piston 26 with the associate cylinder fixed to the frame 16. The actuation of piston 26 is properly programmed so as to periodically control the operation of shear 25; the time interval between two subsequent operations is a function of the strip section length desired.

Figure 4:
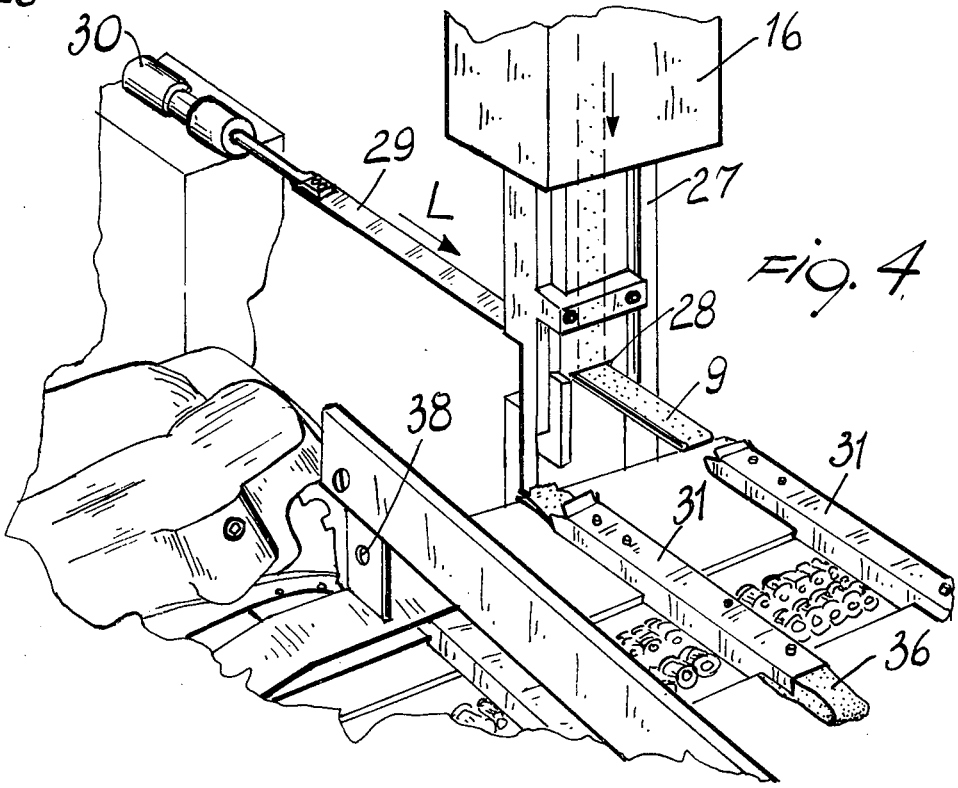
FIG. 4 is a perspective view showing in detail the folding station and the carrying means.

With particular reference to FIGS. 2 and 4, the frame 16 is supported by an hollow column 27 within which the strip 9 slides downwards, driven by the rollers 17 and 18. The column 27 is provided with an aperture 28 having a rectangular cross-section, the horizontal side of which is larger than the strip 9 width. A blade 29, actuated by a piston 30 can be inserted in the aperture 28 thus causing the strip 9 to be folded up. So folded, it gets off from the column 27 at the opposite side to that from which the blade 29 is inserted. As in particular shown in FIG. 4 the strip 9 adhers to the blade 29 moving forward in the direction of arrow L, thus folding itself into two portions of the same length, equal to a half of the perimeter of the ring-shaped article to be obtained. The stroke of blade 29 is controlled according to the different length to be obtained for producing ring-shaped articles of various size. As an alternative solution the use of blades of different length may be provided.

With reference to FIGS. 1, 2, 4 and 5, the automatic apparatus of the present invention provides, downstream of the folding station 3, a transportation station 4 for carrying the folded sections to a sewing station 5. The transportation station 4 comprises a multiplicity of box elements 31 opened at the ends for insertion of the folded sections at one side and the discharge of the ring-shaped articles at the other side, when the article ends have been sewed at the sewing station 5. As it is shown in particular in FIG. 5, the box elements 31 at their central zone are connected to a metallic chain 32 driven by an electric motor not illustrated in the annexed figures, as it is positioned under the work table. The chain 32, as it appears from FIG. 2, is mounted on driving toothed wheels 33. The connection of the box elements 31 to the metallic chain 32 is designed removable so that it is possible to replace such elements 31 when the size of the ring-shaped articles to be obtained, varies. The box elements 31 move on rest planes 34, 35 placed at opposite ends of the box elements 31. In particular the rest plane 34 is positioned at the side of the sewing station, whereas the rest plane 35 is positioned at the side of the device for discharging the finished ring-shaped articles, described in the following.

Figure 5:
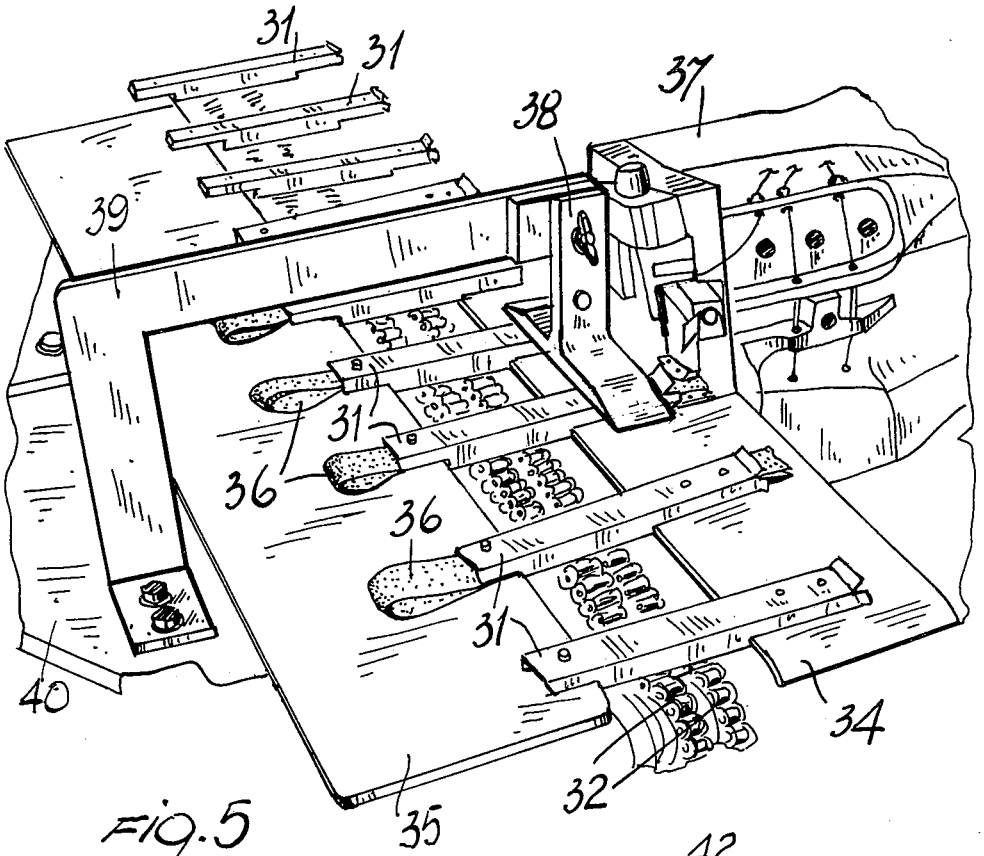
FIG. 5 is a perspective view showing in detail the carrying means and the sewing station.

With particular reference to FIGS. 1, 2 and 5 the apparatus according to the present invention comprises, for sewing together the ends of the folded sections 36, a known sewing machine 37 provided with cutting means, as used at present for forming ring-shaped articles from plaits or strips.

At the head of the sewing machine 37 there is mounted a T-shaped arm 38 for the correct positioning of the box elements 31 during their passage in front of the sewing machine 37. This is provided in order to cause the ends to be sewed to position themselves exactly at the sewing zone of the machine 37. The arm 38 is supported by an L-shaped bracket 39, the other end of which is fixed to the frame 40 of the machine.

Figure 6:
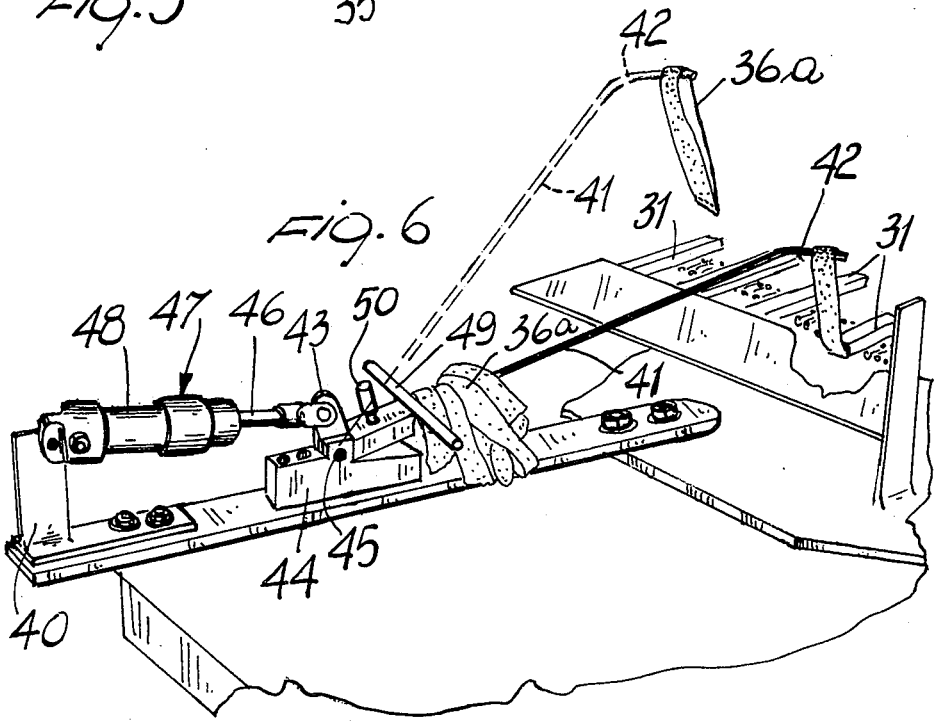
FIG. 6 is a perspective view showing in detail the discharging station of the finished ring-shaped articles.

With particular reference to FIG. 6, the device for discharging the finished ring-shaped articles comprises a movable arm 41 having an end 42 bent in a direction opposite to the movement of the box elements 31. The movable arm 41 is rocking between a first position represented by a continuous line, wherein the end 42 is at the same level of the end of finished ring-shaped articles 36a, end protruding from the box elements 31, and a second position (represented by a dashed line), wherein the arm has caught a finished ring-shaped strip from a box element 31, upon an upward rotation with respect to the first position. For this purpose the arm 41 is removably fixed to a bracket 43 pivotedly mounted by a pin 44 on a support 45. The bracket 43 is linked to the stem 46 of a piston 47 with the associate cylinder 48 being fixed to the machine frame 40. The operation of the piston 47 is therefore such as to cause bracket 43 and thus arm 41 to oscillate between the two above mentioned positions.

Such oscillations are of course synchronized with the movement of the box elements 31 so as to have an upwards rotation each time that the end 42 of the arm 41 is engaged within a finished ring-shaped article. When the arm 41 reaches the uppermost position, the ring-shaped article 36a at the end 42 thereof slides along the arm itself until stopping against a stop 49 on which the other finished ring-shaped articles 36a are subsequently positioned. When a good lot of articles 36a accumulates on the arm 41, the operator stops the apparatus to replace the arm 41 loaded with ring-shaped articles 36a with an empty arm 41 and then restarts the apparatus to carry out another productive cycle.

The operation of the above-described apparatus is the following: upon having positioned a roll of strip within the container 7, the end of strip 9 is inserted between rollers 17 and 18 for its driving. The stroke of blade 29 is adjusted according to the desired perimeter of the ring-shaped articles, having previously checked that the box elements 31 are of an appropriate length.

At this point the apparatus operation changes to completely automatic and the operator has only to control it by actuation of the main switch. The strip 9 moves down in the column 27 and, when a length of strip 9 which is a half length of the perimeter of the ring-shaped article to be obtained, has passed over the aperture 28, the actuation of blade 29 occurs, which causes the strip 9 to be folded in two parts. The shear 25 is operated when the desired length is achieved. The blade 29 projects until completely inserting the folded section 36 within the box element 31 in front thereof. Then the blade 29 retracts and the box element 31 with the folded section 36 moves forward on the planes 34 and 35 towards the sewing machine 37. The box element 31 is positioned by arm 38 and, when passing under the head of machine 37, the ends of the section 36 are sewed. The box element 31 continues its path until the protruding portion of the finished ring-shaped article is caused to be engaged by the end 42 of the arm 41 which then, being controlled by the piston 47, rises and causes the ring-shaped article 36a to drop to the stop 49. The arm 41 then returns to the initial position for gripping another strip 36a.

As it results from the foregoing, the operator, while controlling the operation of the apparatus, acts only during the initial stage of preparation and in the last stage of the productive cycle, which is performed in a completely automatic way by the apparatus itself. Some important advantages result therefrom, which can be so summarized:

1. a reduction of the time necessary to the production of ring-shaped articles;
2. the possibility of entrusting with such work individuals who are not highly skilled;
3. also uniformity of the finished articles, as the work conditions are not modified both for the same operator and for different ones.

It is obvious that many possible variations, modifications and/or additions could be performed in the above described and illustrated apparatus, without therefor exceeding the scope of the present invention as defined in the appended claims.

What I claim is:

1. An automatic apparatus for obtaining ring-shaped articles from an elongated plait or strip of textile material, which comprises: a continuously feeding station for the plait or strip; a cutting station for cutting said plait or strip into sections of prefixed length; a folding station for the sections from said cutting station; a sewing station including means for receiving said folded sections and also including means for sewing together the cut ends of said folded sections to form ring-shaped articles; a transport station for carrying the folded sections to said sewing station wherein the ring-shaped articles are formed; a discharging device for receiving and discharging the finished ring-shaped articles from said transport station.

2. An automatic apparatus according to claim 1, wherein the continuously feeding station comprises a driving means for controlling the movement of the plait or strip from a feed roll to the subsequent cutting station.

3. An automatic apparatus according to claim 2, wherein said cutting station comprises a shear means positioned after said driving means in the direction of movement of the plait or strip.

4. An automatic apparatus according to claim 1, wherein said folding station comprises a blade adapted to be inserted into an aperture of a vertical column wherein the plait or strip sections slide, driving roller means being provided for causing them to slide within said column, whereby each section is caused to leave said column, folded in two portions around said blade.

5. An automatic apparatus according to claim 4, wherein the transport station of said folded sections comprises a plurality of box elements open at their ends, which are transversely movable with respect to the direction of movement of said blade and are adapted to place themselves in turn in front thereof for the insertion of one folded section at each stroke of said blade.

6. An automatic apparatus according to claim 5 wherein said sewing station includes a T-shaped arm co-operating with the box elements for the correct positioning of the ends to be sewed at said sewing station zone.

7. An automatic apparatus according to claim 5, wherein the discharging device for the finished ring-shaped articles comprises a movable arm oscillating between a first position wherein it is placed at the same height of said box elements and a second position wherein it is upwards from the first position.

8. An automatic apparatus according to claim 7, wherein said oscillating arm has an end bent in a sense opposite to the forward movement of said box elements, which is adapted to be inserted within a finished ring-shaped article to allow the subsequent discharge thereof by the upwards motion of said oscillating arm.

* * * * *

UNITED STATES PATENT AND TRADEMARK OFFICE

CERTIFICATE OF CORRECTION

PATENT NO. : 4,075,956

DATED : February 28, 1978

INVENTOR(S) : Orlando Manetti

It is certified that error appears in the above-identified patent and that said Letters Patent are hereby corrected as shown below:

Column 1, line 63, please delete the word "the" and insert therefore the word ----a----.

Column 6, line 15, please delete the word "the", first occurrence, and insert therefore the word ----said----.

Column 6, line 16, after the word "station" please insert a ---- period (.)----.

Column 6, line 17, please delete the word "zone."

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*